United States Patent [19]

Wisander et al.

[11] 4,377,371

[45] Mar. 22, 1983

[54] LASER SURFACE FUSION OF PLASMA SPRAYED CERAMIC TURBINE SEALS

[75] Inventors: Donald W. Wisander, Columbia Station; Robert C. Bill, Rocky River, both of Ohio

[73] Assignee: The United States of America as represented by the Administrator of the National Aeronautics and Space Administration, Washington, D.C.

[21] Appl. No.: 242,795

[22] Filed: Mar. 11, 1981

[51] Int. Cl.[3] ..... F01D 11/08

[52] U.S. Cl. ..... 415/174; 415/197

[58] Field of Search ..... 415/9, 174, 197

[56] References Cited

U.S. PATENT DOCUMENTS

| | | | |
|---|---|---|---|
| 2,930,521 | 3/1960 | Koehring | 415/174 |
| 3,545,944 | 12/1970 | Emanuelson | 415/179 UX |
| 3,817,719 | 12/1974 | Schilke | 415/174 X |
| 3,879,831 | 4/1975 | Rigney et al. | 415/174 X |
| 3,975,165 | 8/1976 | Elbert et al. | 415/174 X |
| 4,004,042 | 1/1977 | Fairbairn | 427/34 |
| 4,024,617 | 5/1977 | McCormick | 29/156.63 |
| 4,080,204 | 3/1978 | Panzera | 415/174 X |
| 4,145,481 | 3/1979 | Gupta et al. | 428/678 |
| 4,247,249 | 1/1981 | Siemers | 415/174 |
| 4,280,975 | 7/1981 | Ammann | 415/200 X |

*Primary Examiner*—Philip R. Coe
*Assistant Examiner*—Frankie L. Stinson
*Attorney, Agent, or Firm*—Norman T. Musial; John R. Manning; Gene E. Shook

[57] ABSTRACT

This invention is directed to improving the thermal shock resistance of a ceramic layer. The invention is particularly directed to an improved abradable lining (16) that is deposited on a shroud (14) forming a gas-path seal in turbomachinery.

Improved thermal shock resistance of a shroud is effected through the deliberate introduction of "benign" cracks. These are microcracks which will not propagate appreciably upon exposure to the thermal shock environment in which a turbine seal must function.

Laser surface fusion treatment is used to introduce these microcracks. The ceramic surface is laser scanned to form a continuous dense layer as shown in FIG. 2. As this layer cools and solidifies, shrinkage results in the formation of a very fine crack network.

The presence of this deliberately introduced fine crack network precludes the formation of a catastrophic crack during thermal shock exposure.

8 Claims, 3 Drawing Figures

LASER SURFACE FUSION OF PLASMA SPRAYED CERAMIC TURBINE SEALS

DESCRIPTION

ORIGIN OF THE INVENTION

The invention described herein was made by employees of the United States Government and may be manufactured and used by or for the Government for governmental purposes without the payment of any royalties thereon or therefor.

TECHNICAL FIELD

In the design of turbines or compressors of the like, especially those of high speed, it is understood that close tolerance between the tips of the blades and the surrounding shroud or housing which seals one side of the blades from the other is desirable. Such a seal reduces the return flow of fluid from the high pressure to the low pressure side. The closer the shroud surrounds the tips of the blades, the more efficient is the turbine or compressor. Aerodynamic losses are also reduced by closer fitting of the blade tips to the shroud.

This seal is achieved by designing the shroud to fit closely, say within 20 to 30 mils (i.e. about 5 to 7 mm.) about the tips of the blades at ambient temperature. Moreover the shroud about the blade is designed to be wearable or abradable relative to the blade tips. Then if there is a thermal transient or shock loading that causes a blade tip to strike the shroud, the blade material flakes off or abrades the shroud material, which may be a sprayed coating or sintered material of low density. Thus the shroud material is abradable (or wearable) with respect to the blade material.

Present day systems also employ either graded composition metal/ceramic layers applied by plasma spray deposition, or low density-low modulus sintered materials brazed to a support backing between a high temperature ceramic material adjacent to the hot turbine gas and a dense metal support backing. The ceramic layer is employed in the as-sprayed condition.

Such a ceramic layer is vulnerable to large scale spallation as cracks induced either by thermal stresses or present in the as-sprayed structure propogate the failure. There is no sufficiently effective crack arrest or local stress mitigation near existing crack tips in conventional as-sprayed structures.

BACKGROUND ART

Fairbairn U.S. Pat. No. 4,004,042 is concerned with applying a wear and impact resistant coating by plasma-spraying tungsten carbide and nickel chrome boron powders onto a base metal. The coating is covered by a layer of nitrogen carried boric acid which forms a glossy protective film. The coating is then fused.

McCormick U.S. Pat. No. 4,024,617 is directed to applying a refractory coating to a ferrous metal substrate by providing a bonding element, such as nickel, at the interface and induction heating the coated substrate to the diffusion temperature.

A corrosion-resistant metal article is achieved by Gupta et al in U.S. Pat. No. 4,145,481 by applying ductile metal overlays. Porosity is limited by heating and applying isostatic pressure.

DISCLOSURE OF INVENTION

This invention is concerned with improving the thermal shock resistance of a plasma-sprayed ceramic layer such as that employed in an abradable lining forming a shroud that encircles the tips of high pressure turbine blades. Improved thermal shock resistance of the shroud is effected through the deliberate introduction of a network of "benign" cracks into the lining.

Benign cracks are defined as microcracks which will not propagate appreciably upon exposure to the thermal shock environment in which a turbine seal must function. Also, these benign cracks will inhibit the initiation of a new crack that may propagate to failure.

The benign crack network is generated by scanning a laser beam over the plasma-sprayed ceramic surface. The laser melts the ceramic material immediately beneath the beam, thereby producing a thin fused layer. Shrinkage accompanying cooling and solidification of the fused layer produces a network of microcracks that resists the formation and growth of a catastrophic crack during thermal shock exposure. An additional beneficial technical effect obtained from this process employed to generate the network of benign cracks is an improvement in the erosion resistance of the plasma-sprayed ceramic surface.

BRIEF DESCRIPTION OF THE DRAWING

The objects, advantages, and novel features of the invention will be more fully apparent from the following detailed description when read in connection with the accompanying drawings in which.

BEST MODE FOR CARRYING OUT THE INVENTION

Figure 1:
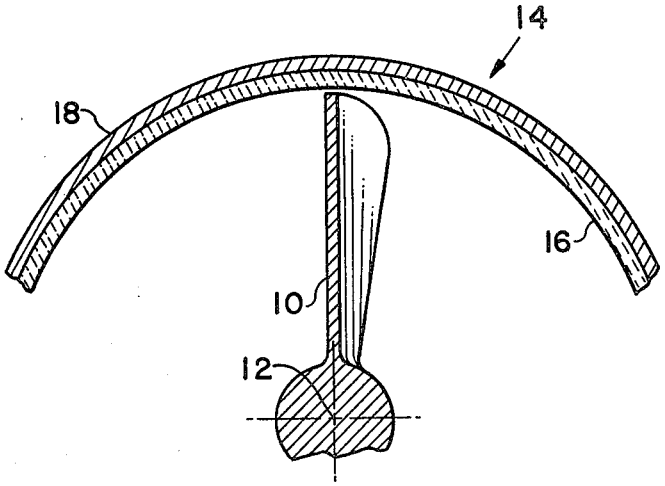
FIG. 1 is a schematic view in transverse cross-section of an arrangement for a turbine or a compressor shroud having an abradable lining treated in accordance with the invention.

Referring now to the drawing a rotor blade 10 of a turbine rotates about an axis 12 in a counter-clockwise direction as shown in the drawing. The fluid in which it operates flows in a direction into the paper. A shroud 14 surround the blade 10 and is substantially concentric with the axis 12.

The shroud 14 includes a layer 16 of a material that is abradable relative to the material in the blade 10. A sprayed ceramic coating 16 on a metal substrate 18 has been found to be suitable for this purpose.

According to the present invention a laser surface fusion treatment is relied on to introduce a fine microcrack network in the plasma-sprayed ceramic surface. More particularly, a laser beam is scanned over the ceramic surface producing a thin, uniform, fused layer on top of the plasma-sprayed ceramic surface.

During the laser fusion process, a thin layer about 0.005 inch thick is melted at the surface. This forms a continuous dense layer on top of the plasma-sprayed ceramic substrate, as shown in FIG. 2.

As this layer cools and solidifies, shrinkage results in the formation of a very fine crack network having a cell size of about 0.040 inch. This network has benign cracks extending a few mils into the ceramic structure. Also, some secondary microcrack damage may be done below this surface.

Figure 2:
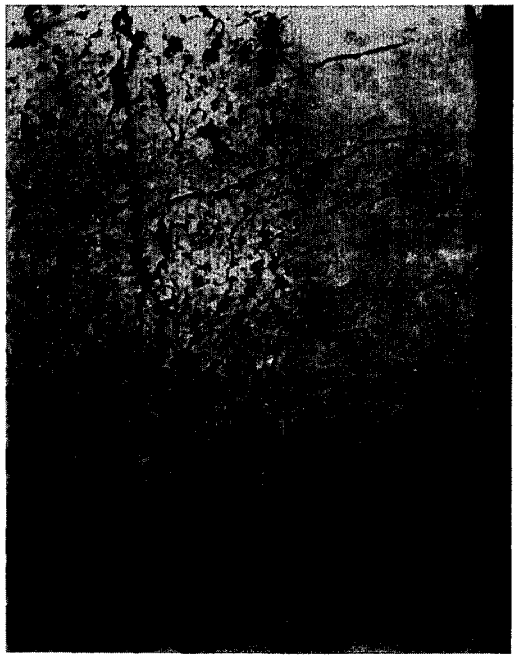
FIG. 2 is a photomicrograph having a 250 magnification of a ceramic shroud that has been glazed by a laser beam in accordance with the present invention.

A continuous wave $CO_2$ laser was used to produce the fused layer shown in FIG. 2. The laser beam diameter was between about 0.030 inch and 0.040 inch, and the beam scan rate was about one inch per second. The beam power used was 175 W.

These particular conditions and values were determined after several trial scans were performed on expendable specimens. These conditions and values, although suitable for the specimen geometry and material shown in FIG. 2, are not necessarily optimum for all applications.

The presence of this deliberately introduced fine crack network precludes the formation of a catastrophic crack during thermal shock exposure. These benign cracks extend the useful life of the ceramic seal.

Figure 3:
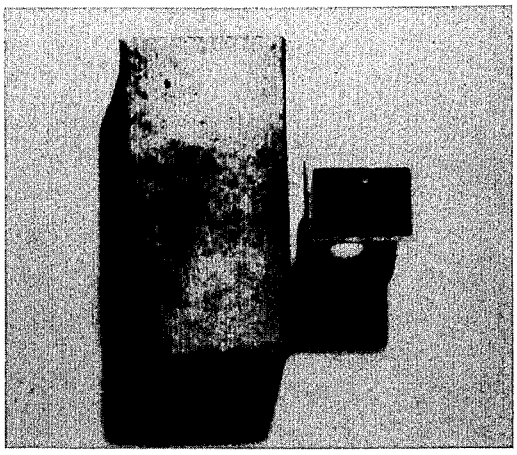
FIG. 3 is a photograph of a plasma-sprayed ceramic layer after thermal shock testing.

An example of a plasma-sprayed ceramic turbine seal thermal shock specimen employing a $ZrO_2$—12% $Y_2O_3$ abradable layer and having been subjected to the laser fusion surface treatment described above is shown in FIG. 3 after 1000 thermal shock cycles. FIG. 3 clearly shows an absence of large cracks propagating through the ceramic layer 16 which are customarily observed after thermal shock testing.

ALTERNATE EMBODIMENT OF THE INVENTION

Another means for achieving improved thermal shock resistance in the plasma-sprayed ceramic turbine seal component is to uniformly heat the entire seal system. The seal is heated to a temperature between 950° to 1000° F.

The hot ceramic surface is then quenched by pressing it against an ethanol saturated paper pad. A beneficial crack network is produced. However, this network is not as fine as that introduced by the laser scanning technique.

While several embodiments of the invention have been described, it will be apparent that various modifications may be made to the invention without departing from the spirit of the invention or the scope of the subjoined claims.

We claim:

1. In a gas path seal for a turbine or the like having a plurality of blades mounted for rotation about an axis, an improved shroud surrounding the tips of said blades in substantially concentric relationship to said axis, said shroud comprising an annular substrate spaced from the tips of said blades, a coating of zirconia that is abradable relative to said blades and closely spaced to said blade tips covering said annular substrate whereby said zirconia abrades when said blades rub against said coating, and a fused layer of zirconia at the surface of the coating adjacent to said blade tips, said fused layer having a network of very fine microcracks for precluding the formation of a catastrophic crack during thermal shock exposure.

2. A gas path seal as claimed in claim 1, wherein the fused ceramic layer has a thickness of about 0.005 inch.

3. A gas path seal as claimed in claim 1, wherein the very fine crack network has a cell size of about 0.040 inch.

4. A gas path seal as claimed in claim 3 wherein the very fine crack network extends from the fused ceramic layer into said ceramic coating.

5. An abradable gas path seal between a member rotating about an axis and an annular substrate forming a shroud concentric with said axis in spaced relationship with said member comprising a $ZrO_2$—12% $Y_2O_3$ coating covering said substrate in close proximity to the outer peripheral surface of said rotating member, and a fused layer of $ZrO_2$—12% $Y_2O_3$ at the surface of said coating adjacent to said member, said fused layer containing a network of very fine microcracks having a cell size of about 0.040 inch extending into said coating.

6. A gas path seal as claimed in claim 5 wherein the fused layer has a uniform thickness.

7. A gas path seal as claimed in claim 6 wherein the fused layer has a thickness of about 0.005 inch.

8. A gas path seal as claimed in claim 5 wherein the very fine network of microcracks extends from the fused layer into the coating.

* * * * *